US010047506B2

(12) United States Patent
Wagner et al.

(10) Patent No.: US 10,047,506 B2
(45) Date of Patent: Aug. 14, 2018

(54) WATER OUTLET FITTING WITH FLEXIBLE OUTLET GUIDE

(71) Applicant: KWC AG, Unterkulm (CH)

(72) Inventors: Benjamin Wagner, Muhen (CH); Hans-Ulrich Alder, Mossleerau (CH)

(73) Assignee: KWC AG, Unterkulm (CH)

( * ) Notice: Subject to any disclaimer, the term of this patent is extended or adjusted under 35 U.S.C. 154(b) by 0 days.

(21) Appl. No.: 15/622,438

(22) Filed: Jun. 14, 2017

(65) Prior Publication Data

US 2017/0275859 A1 Sep. 28, 2017

Related U.S. Application Data

(63) Continuation of application No. 14/321,188, filed on Jul. 1, 2014, now Pat. No. 9,708,801.

(30) Foreign Application Priority Data

Jul. 1, 2013 (EP) ..... 13003329

(51) Int. Cl.
*E03C 1/04* (2006.01)

(52) U.S. Cl.
CPC ..... *E03C 1/0404* (2013.01); *E03C 1/04* (2013.01); *E03C 1/0401* (2013.01); *E03C 1/0412* (2013.01); *E03C 2001/0415* (2013.01)

(58) Field of Classification Search
CPC ..... E03C 1/04; E03C 1/0401; E03C 1/0404; E03C 1/0412; E03C 1/02; E03C 1/042;
(Continued)

(56) References Cited

U.S. PATENT DOCUMENTS 3,412,941 A * 11/1968 Steinback ..... A62C 31/005 239/581.1
3,419,044 A * 12/1968 Daniels ..... A61G 7/1003 137/625.69

(Continued)

FOREIGN PATENT DOCUMENTS

| | | | |
|---|---|---|---|
| CA | 2310194 | A1 | 12/2001 |
| EP | 1944418 | A1 | 7/2008 |
| WO | 2006/038012 | A2 | 4/2006 |

OTHER PUBLICATIONS

Sep. 25, 2014 European Search Report issued in Application No. 14 00 1759.

(Continued)

*Primary Examiner* — J. Casimer Jacyna
(74) *Attorney, Agent, or Firm* — Oliff PLC

(57) ABSTRACT

A water outlet fitting having a base, a hose device with a hose and a water outlet head as well as a holding device including: a mounting portion for mounting the holding device on the base of the water outlet fitting; a locking portion on the free end of the holding device for producing detachable locking of the hose device; and a guide portion for connecting the locking portion to the mounting portion and provide a contact face for the hose device; wherein in a first handling variant the hose device is locked on the holding device, wherein in a second handling variant the hose device is removed from the holding device and is movable in relation to the holding device, and a corresponding holding device. The water outlet fitting has an operating element which is developed in the manner of a stirrup-shaped handle surrounding the water outlet and/or base.

7 Claims, 6 Drawing Sheets

(58) Field of Classification Search
CPC . E03C 1/22; E03C 1/23; E03C 1/2302; E03C 1/2306; E03C 2001/0414; E03C 2001/0415; E03C 2001/0417; E03C 2201/50
USPC ..... 4/675–678; 137/359, 801
See application file for complete search history.

(56) References Cited

U.S. PATENT DOCUMENTS 3,726,318 A * 4/1973 Hyde ..... E03C 1/0404 137/607
D253,607 S * 12/1979 Haug ..... D23/238
D287,995 S * 1/1987 Ferguson ..... D23/245
D324,563 S * 3/1992 Bonnell ..... D23/252
5,749,179 A 5/1998 Bohacik
5,836,333 A 11/1998 Haynes
D497,412 S * 10/2004 Nishi ..... D23/245
7,090,154 B2 8/2006 Herring
D555,771 S * 11/2007 Noth ..... D23/238
7,389,961 B1 6/2008 Haws
8,695,638 B2 * 4/2014 DiNunzio ..... F16K 11/078 137/625.41
8,713,725 B2 5/2014 Alder et al.
D737,935 S * 9/2015 Downey ..... D23/238
2003/0146307 A1 8/2003 Herring
2003/0168100 A1 9/2003 Ericsson
2004/0010848 A1 1/2004 Esche
2006/0085906 A1 4/2006 Tan et al.
2011/0186163 A1 * 8/2011 Farag ..... E03C 1/04 137/801
2014/0069511 A1 3/2014 Rexach et al.
2015/0308088 A1 * 10/2015 Enlow ..... E03C 1/0404 137/1

OTHER PUBLICATIONS

Jul. 22, 2016 Office Action Issued in U.S. Appl. No. 14/321,188.
Nov. 30, 2016 Office Action Issued in U.S. Appl. No. 14/321,188.
Feb. 24, 2014 Extended European Search Report issued in European Application No. 13003329.3.

* cited by examiner

WATER OUTLET FITTING WITH FLEXIBLE OUTLET GUIDE

This is a continuation of application Ser. No. 14/321,188 filed Jul. 1, 2014, which claims the benefit of European Application No. 13003329.3 filed Jul. 1, 2013. The entire disclosures of the prior applications are hereby incorporated by reference herein in their entirety.

BACKGROUND OF THE INVENTION

The invention relates to a water outlet fitting having a base, a hose device with a hose and a water outlet head as well as having a holding device, wherein the holding device allows the water outlet to be guided flexibly in at least two handling variants, as well as a corresponding holding device. In a further aspect, the invention relates to a water outlet fitting having a base, a water outlet protruding from the base and an operating element arranged on the base where the operating element comprises a special arrangement in relation to the water outlet and/or the base.

U.S. Pat. No. 5,749,179 makes known a pre-rinse device which comprises a wall holder, a vertically arranged rising pipe to accommodate an upwardly directed water flow, for example from a tap or a valve of a sink in which items to be cleaned are washed, as well as a hose which extends from the rising pipe to a spray valve at the end of the hose. The hose, in this case, is formed from a flexible outer casing of stainless steel. In addition, a spring mechanism is arranged around the hose which is mounted on the rising pipe in order to hold a substantially vertical portion of the hose in an elastic manner.

EP 1 944 418 B2 describes a water outlet fitting having a flexible water guiding hose, which is connectable to a water supply line at one end and to a shower head at the other end, and having a bendable, form-giving casing element which surrounds the water supply hose. The casing element comprises two portions with a straight axis and one curved, third portion arranged between said two portions with a curved axis. The casing element is also surrounded by a flexible, hose-shaped protective casing. In particular, the casing element is formed by a helical spring, the turns of which in the non-operative state abut against one another in the spring portions with a straight spring axis and in the third spring portion with a curved spring axis abut against one another on the inside of the third spring portion and on the outside surface thereof are arranged at a mutual spacing.

The above described water outlet fittings are relatively expensive to produce and only provide a variability in application that is limited by the respective holder. In addition, in the case of the known water outlet fittings, the operating levers are generally arranged in relation to the base or the outlet such that they are only actuatable by the operating person from certain positions.

BRIEF SUMMARY OF THE INVENTION

It is, consequently, the object of the present invention to provide a water outlet fitting or holding device that is cost-efficient to produce, by means of which a larger variety in application can be achieved and the operating lever of which is as easy as possible to operate.

Said object is achieved according to the invention by a water outlet fitting having a base, a hose device with a hose and a water outlet head, as well as having a holding device, wherein the holding device comprises: a mounting portion for mounting the holding device on the base of the water outlet fitting; a locking portion on the free end of the holding device for producing detachable locking of the hose device; and a guide portion for connecting the locking portion to the mounting portion and, where applicable, for preparing a contact face for the hose device; wherein in a first handling variant (initial position) the hose device is locked on the holding device, and wherein in a second handling variant the hose device is removed from the holding device and is movable freely in relation to the holding device; as well as by a holding device for a water outlet fitting having a correspondingly developed hose device which includes a hose and a water outlet head, and a base, comprising: a mounting portion for mounting the holding device on the base of the water outlet fitting; a locking portion on the free end of the holding device for producing detachable locking of the hose device; and a guide portion for connecting the locking portion to the mounting portion, wherein in all cases the guide portion comprises a curved contact face which surrounds less than half of the circumference of the correspondingly developed hose; and by a water outlet fitting having a base, a water outlet protruding from the base and an operating element arranged on the base, wherein the operating element is developed in the manner of a stirrup-shaped handle which surrounds the water outlet and/or the base.

The wording according to which the hose device is movable freely with respect to the holding device means in the present case that the range of movement of the hose device is not restricted in practice by the holding device. A minimal restriction is provided purely by the mounting portion that is placed onto the base. However, the length of the mounting portion, as a rule, makes up less that 1/10 of the overall length of the holding device.

The wording according to which in all cases the guide portion comprises a curved contact face which surrounds less than half of the circumference of the correspondingly developed hose, means in the present case that a hose with a curvature, which corresponds to the contact face of the guide portion, or with a corresponding radius when abutting closely against the contact face of the guide portion is regularly surrounded by less than half by said contact face. The hoses used have the sizes or diameters that are usual in the area of water outlet fittings, in particular of kitchen and bathroom fittings.

In a preferred embodiment of the present invention, the holding device is formed from an at least partially elastic material. It is made possible in this way for the hose device together with the holding device to be able to be deflected or pivoted out of the initial position in the locked state (third handling variant) if, as a result of the special application for instance, it is not worth removing the hose device from the holding device and wherein the hose device and the holding device are able to return into the initial position again automatically as a result of the resetting force of the at least partially elastic material.

In a further preferred embodiment of the present invention, the at least partially elastic material is a plastics material, in a preferred manner a polyethylene terephthalate (PET). This has proved to be really favorable with regard to the necessary flexibility on the one hand and the required stability on the other hand. The necessary deflectability and resetting are ensured in particular as well as at the same time providing a sufficient resistance to fracture, to cleaning agents along with UV and thermal stability. A particularly balanced ratio can thus be produced between the two aforementioned characteristics. Moreover, such a material is visually more attractive than for example metal and over and above this also comprises characteristics that are ergonomically more favorable. However, the use of metal is conceivable in principle.

In another preferred embodiment of the present invention, the locking portion provides a form-fit locking and/or force-fit locking (friction-locked) connection to the hose device. The possibility for the hose device or the water outlet head to be detached and relocked in relation to the holding device is created as a result. This can occur by means of a clamping, snap-in or click-in connection—for instance in the form of two more or less pliable or resilient side parts at the front end of the locking portion which surround the hose device or the water outlet head in any case in part. A magnetic connection between the hose device or the water outlet head and where applicable the front end of the locking portion is also conceivable in principle.

In another embodiment of the present invention which is once again preferred, an axis X, which is aligned substantially orthogonally to a water outlet surface of the water outlet head, is defined in the initial position. Said axis X preferably forms an angle $\alpha$ of between 0° and 90°, preferably of between 30° and 60°, with a vertical S which extends through the water outlet head.

In a particularly preferred manner in this case, in particular the guide portion and the locking portion are configured in such a manner that—in the initial position—during commissioning and with the water outlet fitting in the operating state, the water outlet head remains aligned substantially along the axis X. In other words, the material of the holding device, the geometric development thereof as well as, where applicable, the development of the pliable or resilient side parts are matched to one another in such a manner that, on the one hand, the hose device cannot become unintentionally detached from the holding device or the locking portion when the operating lever of the water outlet fitting is actuated and water starts to flow and, on the other hand, a notable deflection of the hose and holding device in relation to said X axis will not occur as a result of the pressure of the (continuously) flowing water. Expressed another way, a certain flexibility is also provided in the parked state; the holding device is certainly rigid, but not as rigid as for example metal.

The force which has to be applied by an operator for manually removing the hose device from the locking portion or for deflecting the holding device and the hose device out of the initial position, has therefore to be greater than the compressive force which acts in each case on the holding device or on the respective form-fit locking and/or force-fit locking (friction-locked) connection at the front end of the locking portion as a result of the water having just been turned on or flowing continuously.

In an even more preferred embodiment of the present invention, the holding device comprises recesses, webs, ribs and/or metal inlays. The different development possibilities serve, individually or in combination, for adjusting or adjusting precisely the stability and/or flexibility characteristics that are necessary in each case. These can vary depending on the type of application and on the special geometric development of the holding device.

In a further preferred embodiment of the present invention, the mounting portion is developed in a substantially sleeve-shaped manner. In this way, the mounting portion of the holding device engages completely around a corresponding projection which protrudes from the base of the water outlet fitting such that a particularly solid mounting on the base can be achieved. In particular, however, dirt and calcification can be avoided in the connecting region to the base as a result of the sleeve-shaped or closed mounting portion.

On the other hand, it is also possible for the mounting portion to be developed such that it is able to be snapped onto a corresponding projection on the base, i.e. in this case the mounting portion comprises for instance two resilient side portions. The holding device can thus be exchanged quickly for another, e.g. differently-colored, holding device.

In an even more preferred embodiment of the present invention, the guide portion comprises an arcuate part portion as well as a straight part portion. This has proved particularly favorable with regard to the guiding of the hose device. The guide portion is preferably curved in a concave manner in order to create a corresponding contact face for the hose device.

The hose device is preferably guided along the bottom surface of the guide portion or of the holding device and locked. However, other embodiments where the hose device is guided along the top surface of the holding device are also conceivable. The concave curvature of the guide portion is aligned in a corresponding manner in each case.

For the case where the hose device is guided along the bottom surface of the guide portion or of the holding device, this means that the guide portion is arranged on the rear side of the mounting portion such that the rounding of the mounting portion and the curvature of the guide portion coincide with one another in a corresponding manner. For the case where the hose device is guided along the top surface of the guide portion or of the holding device, this means that the guide portion is arranged on the front side of the mounting portion such that the curvature of the guide portion and the rounding of the mounting portion coincide with one another in a corresponding manner.

The arcuate part portion and the straight part portion comprise in a further preferable manner approximately the same length. In a preferred manner, the length L2 of the arcuate part portion is approximately 1.5 to 2 times as long as the length L1 of the straight part portion. The straight part portion is preferably realized wider than the arcuate part portion. It preferably surrounds the circumference of the hose over approximately twice the length that the arcuate part portion does.

In a further preferred embodiment, the straight part portion comprises two elongated recesses and the arcuate part portion comprises one elongated recess. The elongated recesses of the straight part portion, in this case, are in each case somewhat wider than the elongated recess of the arcuate part portion. A particularly well-balanced ratio between flexibility on the one hand and stability on the other hand is able to be achieved as a result.

The honeycomb structure created by the recesses serves together with the respective material as well as the walk thickness of the holding device for adjusting the desired flexibility. The walk thickness of the holding device is preferably the same in all the portions (except, where applicable, in the connecting region where the mounting portion can have a smaller wall thickness than the remaining holding device).

The wall thickness D of the holding device is preferably between 2 and 8 mm, further preferably between 3 and 7 mm and even more preferred between 4 and 6 mm.

In another preferred embodiment of the present invention, the hose is formed from a substantially dimensionally stable material. This is advantageous in particular with regard to the hose abutting closely against the guide portion or the holding device.

In an embodiment of the present invention which is preferred even more, the holding device has a greater rigidity than the hose. This is expedient above all with regard to as variable as possible a handling of the water outlet fitting.

In an embodiment of the present invention, which is again more preferred, the mounting portion is mounted so as to be rotatable on the base of the water outlet fitting. The variability of the water outlet fitting can be increased, where applicable, in this way.

In another preferred embodiment of the present invention, the stirrup-shaped handle is formed from an at least partially elastic plastics material, preferably polyethylene terephthalate (PET). As a result, the scope for shaping is wider and self-closing can be prevented in practice on account of the relatively low own weight of the stirrup-shaped handle. The stirrup-shaped handle gives somewhat under heavy load as a result of the flexibility of the plastics material and can protect the cartridge in this manner.

According to a further preferred embodiment of the present invention, the stirrup-shaped handle is aligned in such a manner with reference to the water outlet and/or the base that operation is made possible on sides independent of the alignment of the water outlet opening without the water jet having to be crossed at the same time. This is significant above all in the case of medical applications, for example in hospitals. The stirrup-shaped handle is preferably pivotably mounted on the rear top surface of the base such that it surrounds the base forward and toward the sides at approximately the same distance. An approximately ellipse-like form of the stirrup-shaped handle is thus produced. The stirrup-shaped handle does not cross the axis X in this case.

The stirrup-shaped handle with its above-described developments can also be used together with the holding device according to the invention. As both components have the same flexibility, the hose or the water outlet head can thus be prevented from coming detached, where applicable even when the water outlet fitting is actuated in a very jerky manner.

A further advantage of the water outlet fitting according to the invention is that practically no noise occurs when returning/resetting the hose device and where applicable the holding device.

All in all, the water outlet fitting according to the invention offers easy accessibility and is very service friendly.

BRIEF DESCRIPTION OF THE SEVERAL VIEWS OF THE DRAWING

Preferred embodiments of the present invention will now be illustrated as an example in the accompanying drawings, in which.

DETAILED DESCRIPTION OF THE INVENTION

Figure 1:
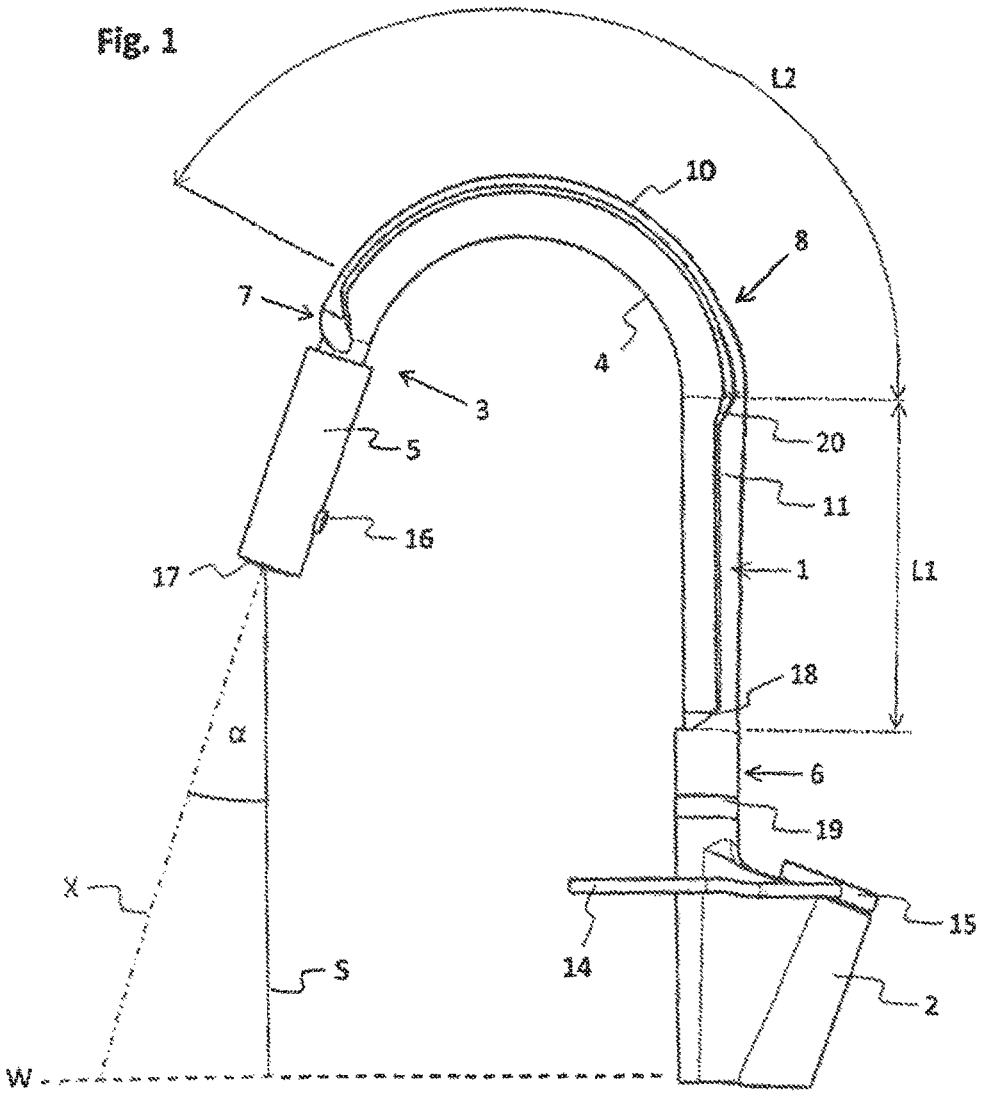
FIG. 1 shows a side view of a water outlet fitting according to the invention with a holding device according to the invention.

FIG. 1 illustrates a side view of a water outlet fitting according to the invention with a holding device 1 according to the invention. The base 2 of the water outlet fitting is usually arranged on a washstand which is not shown, however, in the present case. A stirrup-shaped handle 14 with a handle head part 15 is pivotably mounted on the top surface of the base 2. When the stirrup-shaped handle 14 is actuated in the upward direction, the water begins to run. The holding device 1 is connected to the base 2 in the connecting region 19 by means of its mounting portion 6. The mounting portion 6, in this case, is usually slipped onto the base 2. In this context, the mounting portion and the corresponding base part are correspondingly realized such that they coincide with one another.

A guide portion 8 connects to the mounting portion 6 of the holding device 1 by way of a straight part portion 11. The transition is stabilized by supporting struts 18 on both sides. The straight part portion 11 of the guide portion 8 has a length L1, including the support struts 18 and a transition region 20, in which the width of the guide portion is reduced. Connecting to said transition region 20, the straight part portion 11 merges into the arcuate part portion 10 which has a length L2.

The locking portion 7 of the holding device 1 then connects to the arcuate part portion 10 of the guide portion 8. The hose device 3, or in the present exemplary embodiment the hose 4, is held at the locking portion 7. The water outlet head 5 of the hose device 3 stands out from the locking portion 7 of the hose device 3 and additionally comprises a changeover knob 16. The spray pattern of the water outlet fitting can be changed over from a (softer) rinsing jet to a (harder) shower jet by means of the changeover knob 16.

The water outlet surface 17 is situated at the free end of the water outlet head 5. Said water outlet surface, as a rule, is developed in the form of a filter element. The water outlet head 5 is aligned such that its longitudinal axis X forms an angle $\alpha$ with a vertical S (which is at right angles to the horizontal W). The angle $\alpha$ lies regularly between 0° and 90°, preferably between 30° and 60.

Figure 2:
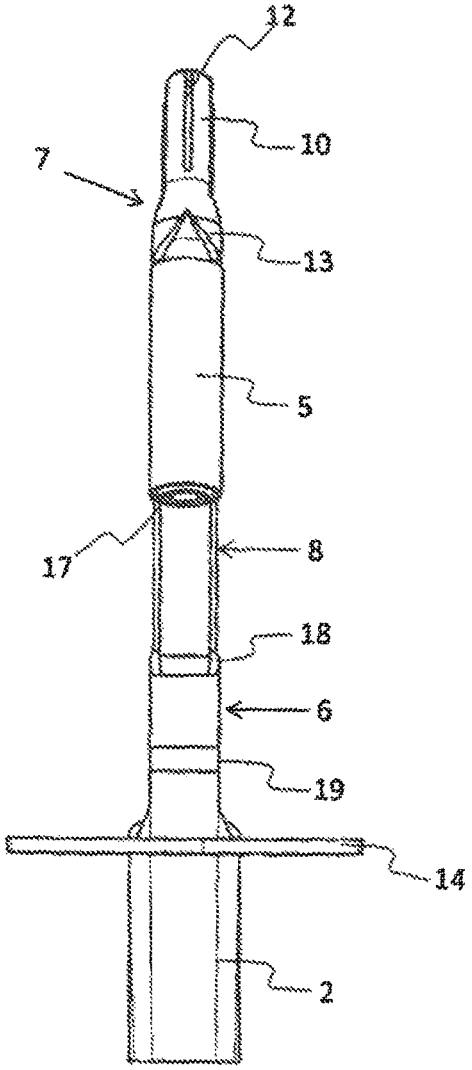
FIG. 2 shows a front view of a water outlet fitting according to the invention with a holding device according to the invention.

In the front view according to FIG. 2, the base 2 of the water outlet fitting and the stirrup-shaped handle 14 arranged thereon can once again be seen. The mounting portion 6 connects to the base 2 once again in the connecting region 19. As can be seen, the support struts 18 of the guide portion 8 are lightly curved. The arcuate part portion of the guide portion 8 comprises an elongated recess 12 which extends for instance as far just before the locking portion 7 of the holding device 1. The locking portion 7, in turn, includes two resiliently developed side parts 13 with which, in the present exemplary embodiment, the hose 4 of the hose device 3 enters into a force-fit locking and form-fit locking connection. The water outlet head 5 abuts against the resilient side parts 13 of the locking portion 7. The water outlet surface 17 or the filter element can be seen once again at the free end of the water outlet head 5.

Figure 3:
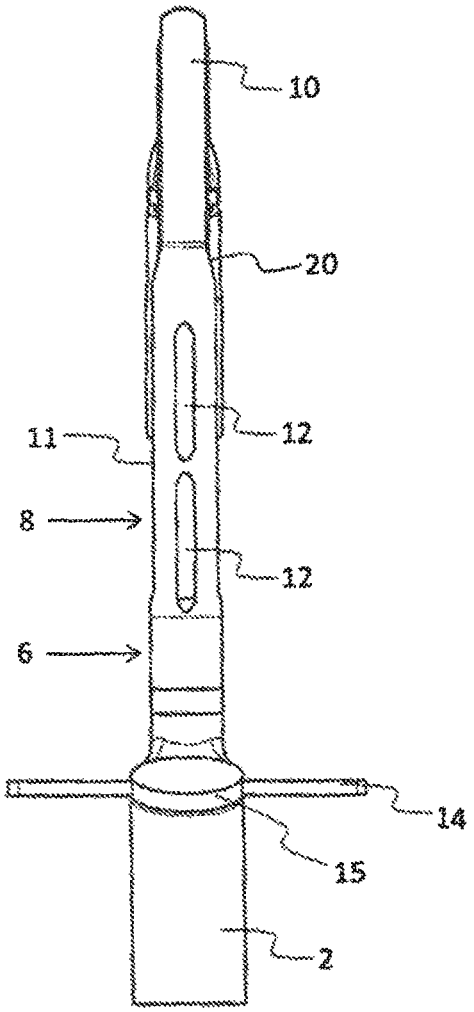
FIG. 3 shows a rear view of a water outlet fitting according to the invention with a holding device according to the invention.

In the rear view according to FIG. 3, it is possible to see the rear side of the base 2 and the handle head part 15 by way of which the stirrup-shaped handle 14 is pivotably mounted on the base 2. The guide portion 8, which connects to the mounting portion 6 of the holding device 1, comprises in the region of its straight part portion 11 two elongated recesses 12 which extend over the largest part of the straight part portion 11 of the guide portion 8 of the holding device 1 according to the invention. Once again, it is possible to see the change in width in the holding device in the transition region 20. The arcuate part portion 10 of the holding device according to the invention, which connects to the straight part portion 11, does not comprise a recess in the region shown, it does comprise, however, a width that is clearly smaller than the straight part portion 11 or than the water outlet head 5.

Figure 4:
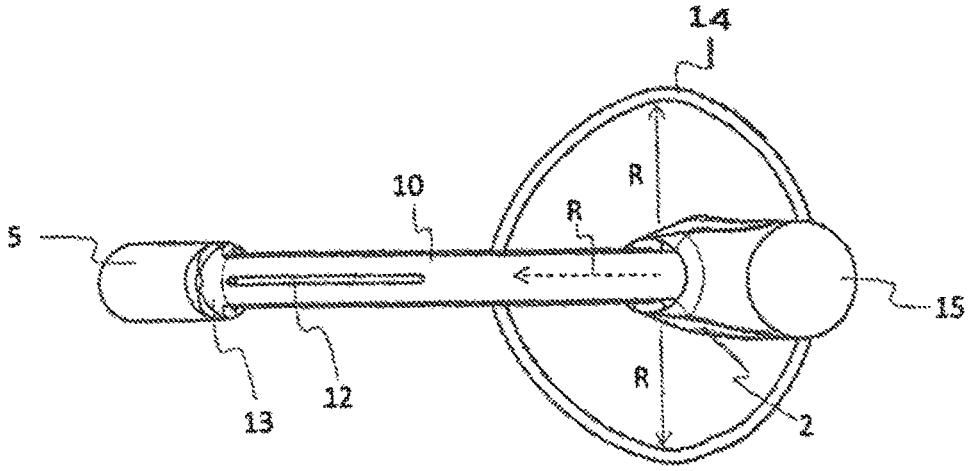
FIG. 4 shows a top view of a water outlet fitting according to the invention with a holding device according to the invention.

In the top view according to FIG. 4, it can be seen in particular how the stirrup-shaped handle 14 is pivotably mounted on the base 2 of the water outlet fitting by means of the handle head part 15. The stirrup-shaped handle 14, in this case, surrounds the base and the mounting portion 6 as well as the guide portion (at least in part) of the holding device according to the invention. The radii R shown of the approximately ellipse-shaped stirrup-shaped handle 14 are approximately the same size.

In this way, particularly advantageous usability is provided, in particular with regard to applications in the medical area, i.e. for example in hospitals where such a handle has possibly to be operated by persons who only have one hand available. Here too, the arcuate part portion 10 of the guide portion 8 of the holding device according to the invention comprises an elongated recess 12 which extends approximately as far as up to the resilient side parts 13 of the locking portion 7. Once again, the water outlet head 5 connects thereto.

Figure 5:
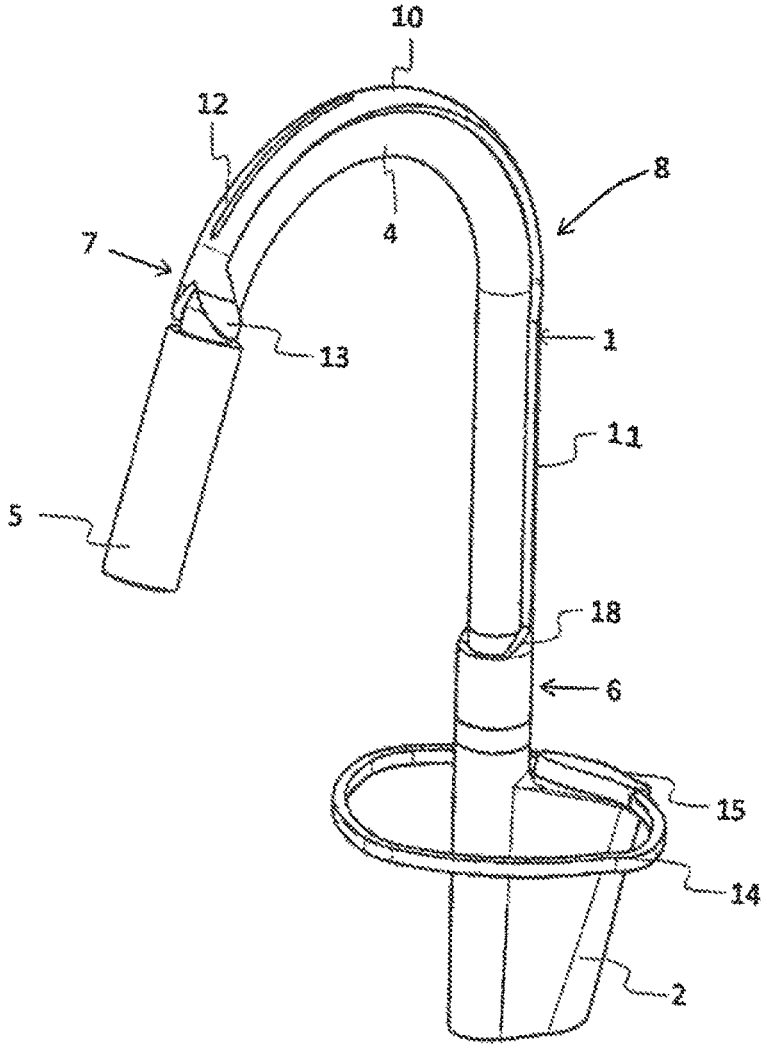
FIG. 5 shows a perspective view of a water outlet fitting according to the invention with a holding device according to the invention.

FIG. 5 provides a perspective view of the water outlet fitting according to the invention with the holding device according to the invention. Here, in particular the good accessibility of the stirrup-shaped handle 14 is once again illustrated from the front.

Figure 6:
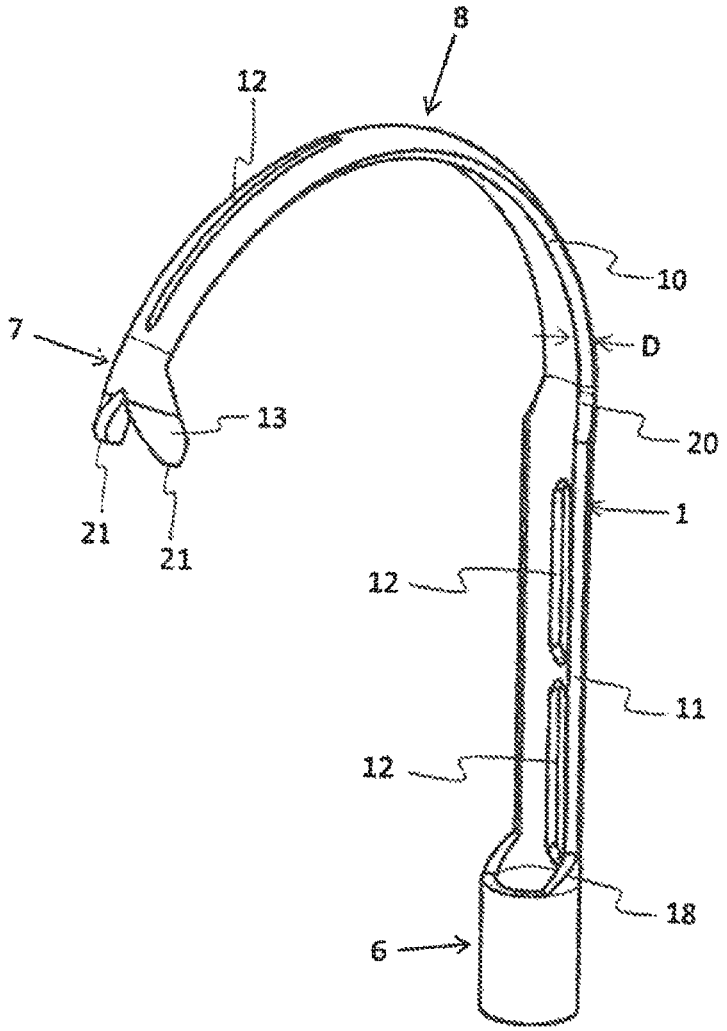
FIG. 6 shows a perspective view of a holding device according to the invention.

FIG. 6 once again shows a perspective view of the holding device according to the invention on its own. Above all the two elongated recesses 12 which lie one above another can be seen in the straight part portion of the guide portion 8 as well as the elongated recess 12 in the arcuate part portion of the guide portion 8 which reaches approximately as far as up to the locking portion 7. The recesses 12 serve in each case to increase the flexibility of the holding device 1 and support—after a deflection by a user—the return into the initial position.

Metal inlays, webs or however combined designs thereof can also be provided in place of the recesses depending on the application. The mounting portion 6 is developed in the present case in a sleeve-shaped manner, i.e. closed. However, in another embodiment (not shown here) it can also consist of two non-connected, resilient side parts which are snapped onto the base.

The important point in each case is that the holding device is configured such that even if the stirrup-shaped handle is actuated in an abrupt manner, the hose device does not fall out of the locking portion or become (unintentionally) detached from said locking portion and that in operation the holding device does not allow any substantial deviation from the X axis of the water outlet head shown in FIG. 1.

The resilient side parts 13 of the locking portion 7 preferably comprise stop faces or stop shoulders 21 for the water outlet head in order to ensure secure support of the same. The recesses in the straight part portion 11 of the guide portion 8, as a rule, are somewhat wider and somewhat shorter than the elongated recess in the arcuate part portion 10.

The mounting portion 6 and the locking portion 7 make up less than ⅛, preferably less than 1/10 of the overall length of the holding device. The wall thickness D of the holding device 1 is substantially the same in all the portions. It is preferably between 2 and 8 mm, further preferably between 3 and 7 mm and even more preferred between 4 and 6 mm.

LIST OF REFERENCES

1 Holding device
2 Base
3 Hose device
4 Hose
5 Water outlet head
6 Mounting portion
7 Locking portion
8 Guide portion
9 Arcuate part portion
10 Straight part portion
11 Recesses
12 Resilient side parts
13 Stirrup-shaped handle
14 Handle head part
15 Changeover knob
16 Water outlet surface
17 Support webs
18 Connecting region
19 Transition region
20 Stop shoulders
D Wall thickness
L1 Length of the straight part portion
L2 Length of the curved part portion
R Radius
S Vertical
W Horizontal
X Axis
A Angle

The invention claimed is:

1. Water outlet fitting having
a base comprising a connecting region and a rear region, where the rear region is disposed on a side of the base that is opposite to a side of the base comprising the connecting region,
a water outlet that projects from the base in the connecting region thereof, and
an operating element pivotally mounted on a top surface of the rear region of the base, wherein
the operating element is configured in the manner of a stirrup-shaped handle with a handle head part such that when the operating element is actuated water starts to flow,
the stirrup-shaped handle is pivotally mounted on a rear top surface of the rear region of the base via the handle head part such that stirrup-shaped handle with the handle head part encompasses the water outlet and the base in vertical projection, and
the stirrup-shaped handle with the handle head part is articulated on the rear top surface of the rear region of the base so that it encompasses the connecting region of the base at approximately the same distance (R) therefrom towards the front and towards the sides.

2. The water outlet fitting according to claim 1, wherein the stirrup-shaped handle is formed from an at least partly resilient plastics material.

3. The water outlet fitting according to claim 2, wherein the at least partly resilient plastics material comprises polyethylene terephthalate.

4. The water outlet fitting according to claim 1, wherein the stirrup-shaped handle is aligned relative to the water outlet and/or the base in such a way that it can be operated from all sides, independently of the alignment, without it being necessary for the water jet to be crossed.

5. The water outlet fitting according to claim 2, wherein the stirrup-shaped handle is aligned relative to the water outlet and/or the base in such a way that it can be operated from all sides, independently of the alignment, without it being necessary for the water jet to be crossed.

6. The water outlet fitting according to claim 3, wherein the stirrup-shaped handle is aligned relative to the water outlet and/or the base in such a way that it can be operated from all sides, independently of the alignment, without it being necessary for the water jet to be crossed.

7. The water outlet fitting according to claim 1, wherein the stirrup-shaped handle is formed from polyethylene terephthalate.

* * * * *